US005427294A

United States Patent [19]

VandenHeuvel et al.

[11] Patent Number: 5,427,294

[45] Date of Patent: Jun. 27, 1995

[54] METHOD AND APPARATUS FOR BREAKING FILM PERFORATIONS

[75] Inventors: Greg J. VandenHeuvel, Kaukauma; Christopher E. Dubey, Neenah, both of Wis.

[73] Assignee: Reynolds Consumer Products Inc., Appleton, Wis.

[21] Appl. No.: 150,949

[22] Filed: Nov. 12, 1993

[51] Int. Cl.[6] ..... B65H 35/10

[52] U.S. Cl. ..... 225/4; 225/100

[58] Field of Search ..... 225/4, 5, 100; 226/114

[56] References Cited

U.S. PATENT DOCUMENTS

| | | | |
|---|---|---|---|
| 2,523,183 | 9/1950 | Beall | 225/100 X |
| 2,685,417 | 8/1954 | Bartelson | 242/75 |
| 3,163,341 | 12/1964 | Fisher et al. | 225/100 |
| 4,025,023 | 5/1977 | Moffitt | 225/5 X |
| 4,515,321 | 5/1985 | Kahlman | 242/56 R |
| 5,156,241 | 10/1992 | Sugie et al. | 225/4 X |

*Primary Examiner*—Richard K. Seidel
*Assistant Examiner*—Clark F. Dexter
*Attorney, Agent, or Firm*—Alan T. McDonald

[57] ABSTRACT

A method for breaking film perforations between a plurality of adjacent films employs an in-feed device, an out-feed device, and a festooner positioned between the in-feed device and the out-feed device. The in-feed device and the out-feed device move the plurality of adjacent films downstream through the festooner, which includes a plurality of rollers extending from a rotatable hub shaft. To perform the method, the hub shaft is first rotated to a home position. Next, a first film is fed through the festooner and into the out-feed device using the in-feed device. The out-feed device moves film downstream at a slower speed than the in-feed device. The hub shaft is then rotated at a high boost speed so that the rollers take up slack in the first film generated by the slower speed of the out-feed device relative to the in-feed device. Finally, while the perforations between the first film and an upstream adjacent second film are located between the in-feed device and the festooner, the hub shaft is rotated at a slow speed relative to the high boost speed so as to controllably break the perforations.

47 Claims, 4 Drawing Sheets

METHOD AND APPARATUS FOR BREAKING FILM PERFORATIONS

FIELD OF THE INVENTION

The present invention generally relates to methods and apparatus for breaking film perforations and, more particularly, relates to a method and apparatus for breaking film perforations which maintains control over the film during the breaking operation.

BACKGROUND OF THE INVENTION

In packaging applications involving garbage bags and food storage bags, the bags are often connected in series by perforations and wound about a dispensing roll. To remove a leading bag from the dispensing roll, one unwinds the bag from the dispensing roll and breaks the perforation connecting the bag to the adjacent bag on the roll.

Since removing bags in the foregoing manner can be a difficult task, automated techniques have been developed for breaking the perforations between adjacent bags prior to winding the bags about a dispensing roll. To remove a bag from the dispensing roll, the bag is simply unwound from the roll. In one such automated technique, a series of bags connected by perforations are fed by feed rollers through a festooner and to a conveyor. The conveyor operates at a slower speed than the feed rollers. The festooner is driven with a low clutch, a high clutch, and a brake that are mechanically connected by an assembly of belts and pulleys. The festooner operates at three different speeds, depending upon the position of a bag passing through the festooner. First, the festooner operates at a slow speed to take up slack generated in a bag as it passes into the conveyor. After the slack in the bag is taken up, the festooner operates at a relatively high speed to "snap" the perforation between the trailing edge of the bag and the leading edge of the next adjacent bag prior to passage of the trailing edge of the bag through the festooner. After the perforation is snapped, the festooner is stopped by a brake so that it is in a position to receive the now disconnected leading edge of the adjacent bag. Once the leading edge of the adjacent bag passes through the festooner and into the conveyor, the foregoing process for breaking the perforation at the trailing edge of this adjacent bag is repeated.

The foregoing technique is disadvantageous because it fails to adequately control the bags as the perforations therebetween are broken. For example, by "snapping" the perforations between two bags while the festooner is rotating at high speeds and then suddenly stopping festooner rotation, there is minimal positive control over the trailing portion of the lead bag and the leading portion of the adjacent trailing bag. This can cause the trailing portion of the lead bag to swing out of control ahead of the remainder of the lead bag and get improperly entangled in the conveyor. Similarly, this "snapping" action can cause the leading portion of the trailing bag to swing backward and get entangled about the feed rollers.

Another drawback of the foregoing technique is that using high speed rotation to snap perforations can lead to inconsistent perforation breaks. If the perforation break is made either too quickly or in the wrong location, the leading edge of the trailing bag becomes skewed. This skewed leading edge can then become entangled in the festooner. Also, when the bags are later wound on a dispensing roll, the skewed edge may not properly align with the other bags on the roll.

A need therefore exists for a method and apparatus for breaking film perforations which overcomes the above-noted drawbacks associated with the foregoing technique.

SUMMARY OF THE INVENTION

Accordingly, the present invention provides a method for breaking film perforations between a plurality of adjacent films. The method employs an in-feed device, an out-feed device, and a festooner positioned between the in-feed device and the out-feed device. The in-feed device and the out-feed device move the plurality of adjacent films downstream through the festooner, which includes a plurality of rollers extending from a rotatable hub shaft. To perform the method, the hub shaft is first rotated to a home position. Next, a first film is fed through the festooner and into the out-feed device using the in-feed device. The out-feed device moves film downstream at a slower speed than the in-feed device. The hub shaft is then rotated at a high boost speed so that the rollers take up slack in the first film generated by the slower speed of the out-feed device relative to the in-feed device. Finally, while the perforations between the first film and an upstream adjacent second film are located between the in-feed device and the festooner, the hub shaft is rotated at a slow speed relative to the high boost speed so as to controllably break the perforations.

BRIEF DESCRIPTION OF THE DRAWINGS

The advantages of the present invention will become apparent upon reading the following detailed description and upon reference to the accompanying drawings, in which.

DETAILED DESCRIPTION OF THE PREFERRED EMBODIMENT

Figure 1:
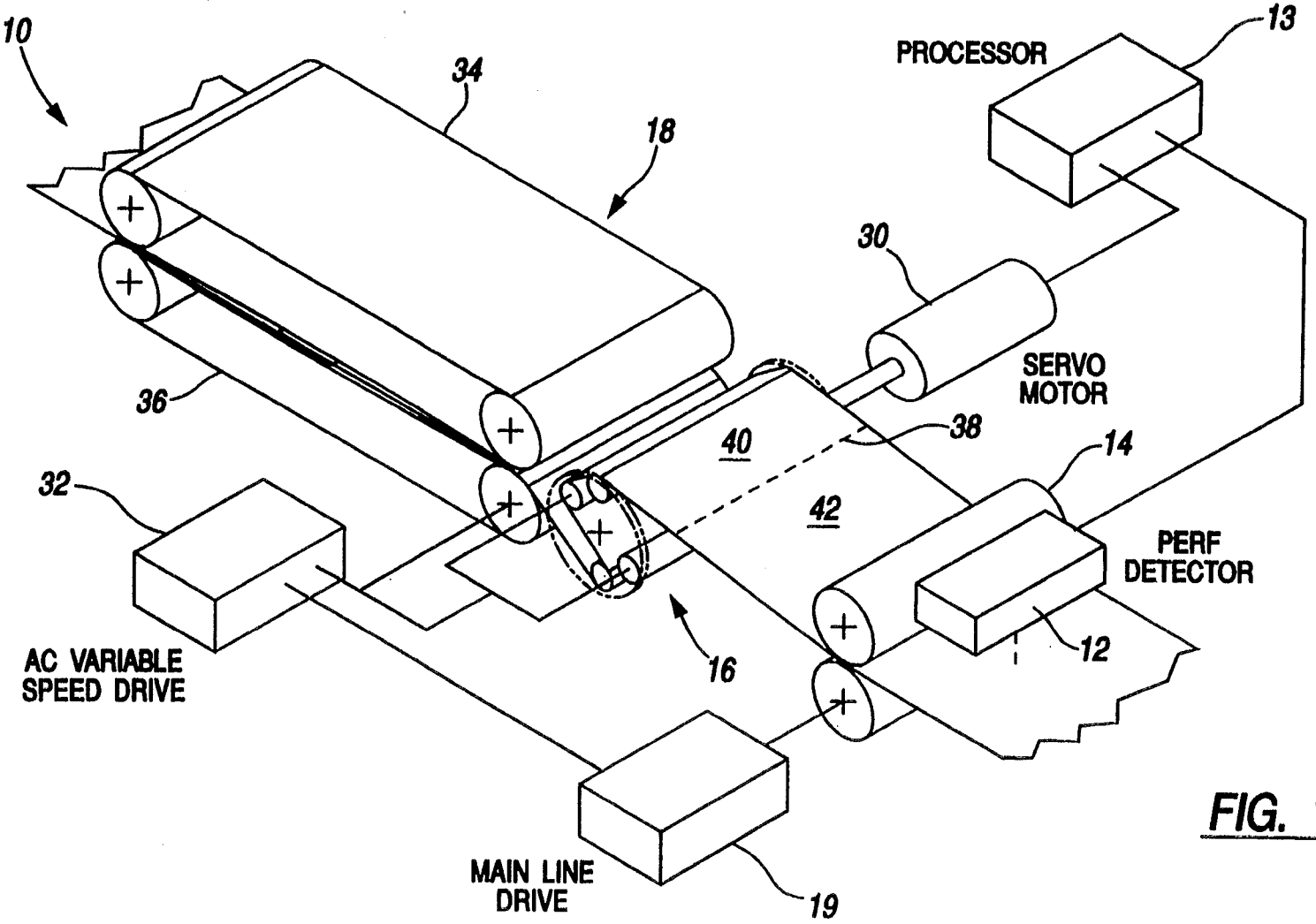
FIG. 1 is a perspective view of the apparatus for breaking film perforations embodying the present invention.

While the invention is susceptible to various modifications and alternative forms, a specific embodiment thereof has been shown by way of example in the drawings and will be described in detail. It should be understood, however, that it is not intended to limit the invention to the particular form described, but, on the contrary, the intention is to cover all modifications, equivalents, and alternatives falling within the spirit and scope of the invention as defined by the appended claims.

Turning now to the drawings, FIG. 1 illustrates an apparatus 10 for breaking perforations along a strip containing a plurality of plastic bags. The apparatus 10 includes a high voltage perforation detector 12, a processor 13, a pair of in-feed rollers 14, a festooner 16, and a conveyor 18. A bag on the strip first passes beneath the perforation detector 12, which detects the perforations between adjacent bags. The perforation detector 12 operates by emitting sparks in the direction of the strip of bags. The grounding of these sparks indicates the presence of a perforation along the strip. As discussed below, the apparatus 10 uses the perforation detector 12 and the processor 13 to change the rotational speed of the festooner 16.

Next, a bag on the strip passes between the in-feed rollers 14, which are driven by a main line drive 19 and which rotate in opposite directions to propel the bag downstream at the tangential velocity of the in-feed rollers 14. Following passage between the in-feed rollers 14, the bag passes through the festooner 16. The festooner 16 includes four rollers 20, 22, 24, and 26 (see FIGS. 2*a–f*) connected to a hub shaft 28 which is rotatably driven by a servomotor 30. The rollers 20 and 22 are considered to be home position rollers and the rollers 24 and 26 are considered to be non-home position rollers. The speed at which the servomotor 30 rotates the hub shaft 28 is controlled by the perforation detector 12 and the processor 13. While the hub shaft 28 is rotating, the rollers 20, 22 are rotatably driven (counterclockwise in FIGS. 2*a–f*) by an AC variable speed drive 32, which also drives the conveyor 18. The AC variable speed drive 32 is connected to the main line drive 19 and rotates these rollers 20, 22 at approximately the same tangential velocity as the in-feed rollers 14. Thus, the festooner rollers 20, 22 propel the bag downstream at approximately the same speed as the in-feed rollers 14. The other two rollers 24, 26 are frictionally driven by the movement of the bag itself over these rollers. As the bag passes through the festooner 16, the festooner 16 pulls the bag (reference numeral 40 in FIG. 1) relative to the next adjacent upstream bag (reference numeral 42) until the perforations between trailing edge of the lead bag 40 and the leading edge of the next adjacent bag 42 are broken. The perforation detector 12 signals the processor 13 to vary the rotational speed of the hub shaft 28 such that the apparatus 10 maintains control over both the lead bag 40 and the next adjacent bag 42 during the entire breaking process.

As the festooner 16 breaks the perforation at the trailing edge of the lead bag 40, the leading edge of the lead bag 40 is already passing through the conveyor 18. The conveyor 18 includes a pair of conveyor belts 34, 36 positioned directly opposite one another, and the bags on the strip pass through a small gap between the conveyor belts. The conveyor 18 is driven by the AC variable speed drive 32 at a speed which follows the main line drive 19. Thus, any changes in the driving speed of the main line drive 19 cause the AC variable speed drive 32 to automatically adjust its driving speed. To permit overlap between bags after the perforations therebetween are broken, this conveyor speed is slower than the tangential velocity of the in-feed rollers 14. This causes the leading edge of the next adjacent bag to enter the conveyor 18 prior to the trailing edge of the slower-moving lead bag. This overlap facilitates winding the overlapping bags into a dispensing roll (not shown) downstream from the conveyor 18.

The in-feed rollers 14 and the conveyor 18 provide for continuous motion of the strip of bags through the apparatus 10 while the festooner 16 controllably breaks the perforations between adjacent bags. FIG. 2 is a sequence of diagrams illustrating the process of breaking perforations 38 connecting a first bag 40 to a second bag 42. For the sake of illustration, the operation of the apparatus 10 is described below for bags which are 30 inches long.

While the festooner 16 is stationary in the home position (FIG. 2*a*), the bag flow path between the in-feed rollers 14 and the conveyor 18 is linear. At this time, the first bag 40 extends from the perforation detector 12 to the upstream end of the conveyor 18. The first bag 40 moves tangentially over the festooner rollers 20, 22, which have the approximately the same tangential velocity as the in-feed rollers 14. Therefore, these rollers 20, 22 drive the first bag 40 downstream at approximately the same speed as the in-feed rollers 14. The festooner 16 remains in the home position until the leading edge of the first bag 40 just enters the small gap between the conveyor belts 34, 36.

The location of this leading edge of the first bag 40 is determined using the perforation detector 12. The perforation detector 12 had initially detected the leading edge of this first bag 40 as it passed beneath the perforation detector 12 upstream from the in-feed rollers 14. In response to this detection of the perforations at the leading edge of the first bag 40, the processor 13 starts counting clock pulses. Since the in-feed rollers 14 move the bags downstream through the apparatus 10 at a predetermined number of pulses per inch, the location of the leading edge of the first bag 40 relative to the perforation detector 12 is determined by dividing the number of clock pulses by the bag movement rate. In the preferred embodiment, the bag moves downstream at a rate of four pulses per inch and the festooner 16 is held stationary until the processor 13 counts 96 pulses, i.e., the leading edge of the first bag 40 is located 24 inches from the perforation detector 12. The apparatus 10 is constructed so that the leading edge of the first bag 40 is located just within the conveyor 18 when the leading edge is located 24 inches from the perforation detector 12.

Figure 2A:
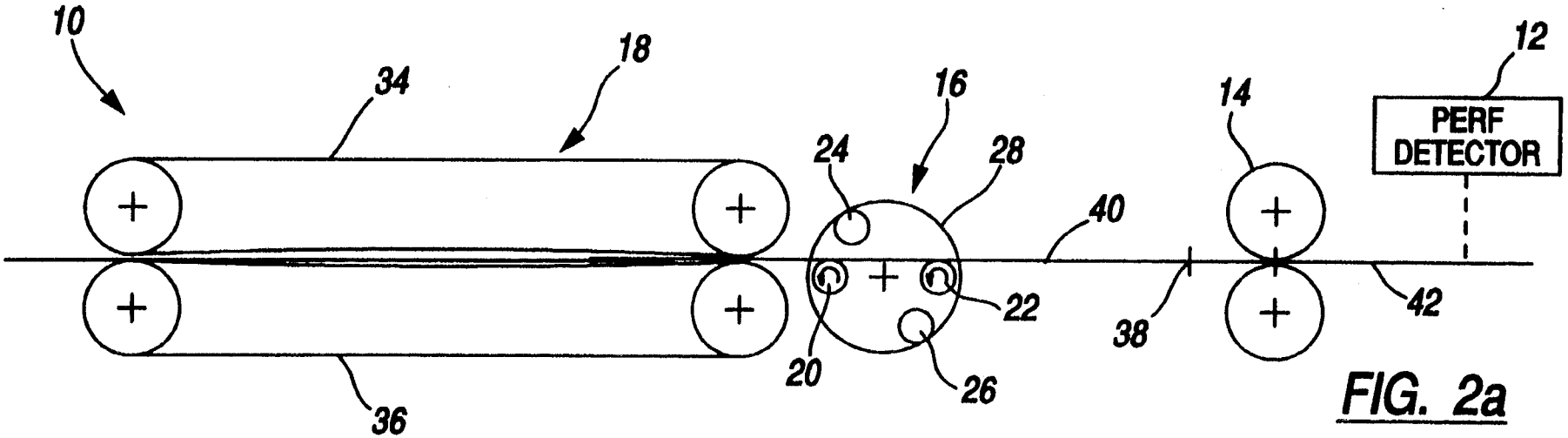
FIG. 2*a* is a side view of the apparatus in FIG. 1 with a festooner in a home position and a bag extending through the festooner and into a conveyor.
Figure 2B:
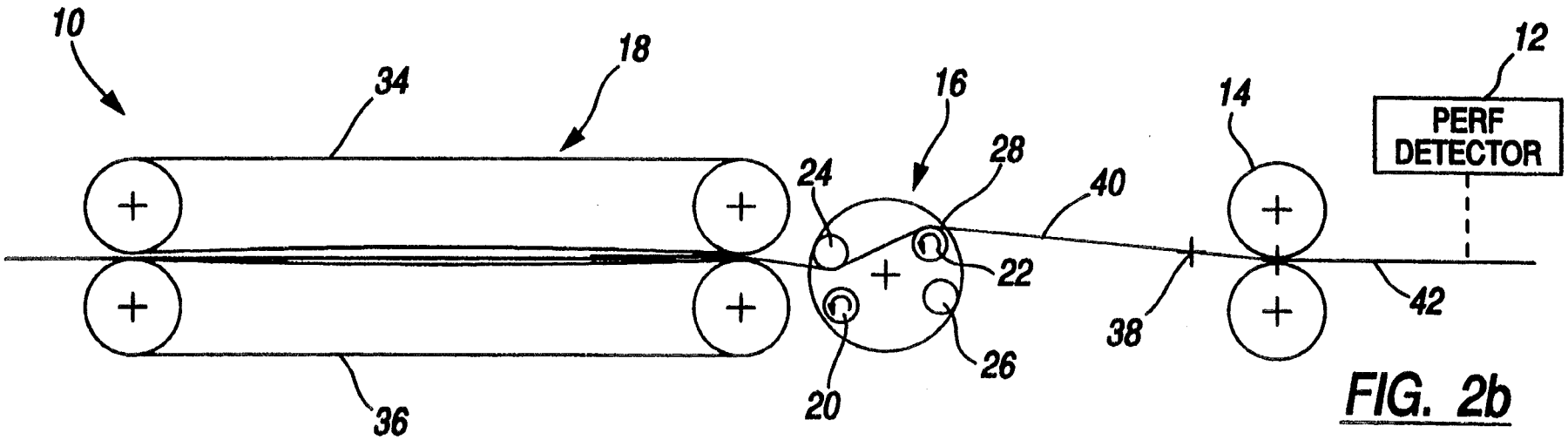
FIG. 2*b* is a side view of the apparatus in FIG. 1 with the festooner rotated slightly away from the home position to take up slack in the bag.

After the processor 13 determines that the leading edge of the first bag 40 is located 24 inches from the detector 12, the servomotor 30 rotates the hub shaft 28 of the festooner 16 at a high boost speed (e.g., boost speed) in order to take up slack generated in the first bag 40 (FIG. 2*b*). This slack is generated in the first bag 40 as its leading end is moved downstream by the conveyor 18 at a slower speed than its trailing end, which is pushed downstream by the second bag 42 at the line speed. While the hub shaft 28 is rotated counterclockwise at the high boost speed in FIG. 2*b*, the rollers 22, 24 take up the bag slack by forming the first bag 40 into an S-shape. The rollers 22, 24 apply forces to the first bag 40 which are approximately perpendicular to the linear flow of the first bag 40 between the in-feed rollers 14 and the conveyor 18. The hub shaft 28 continues to rotate at the high boost speed until the perforations 38 between the first and second bags 40, 42 are located downstream from the in-feed rollers 14. In the preferred embodiment, the hub shaft 28 rotates at the high boost speed until the perforations 38 are located eight inches downstream from the perforation detector 12. The hub shaft 28 rotates in high boost speed through an angle of about 21 degrees by the time the perforations 38 are eight inches from the perforation detector 12.

Figure 2C:
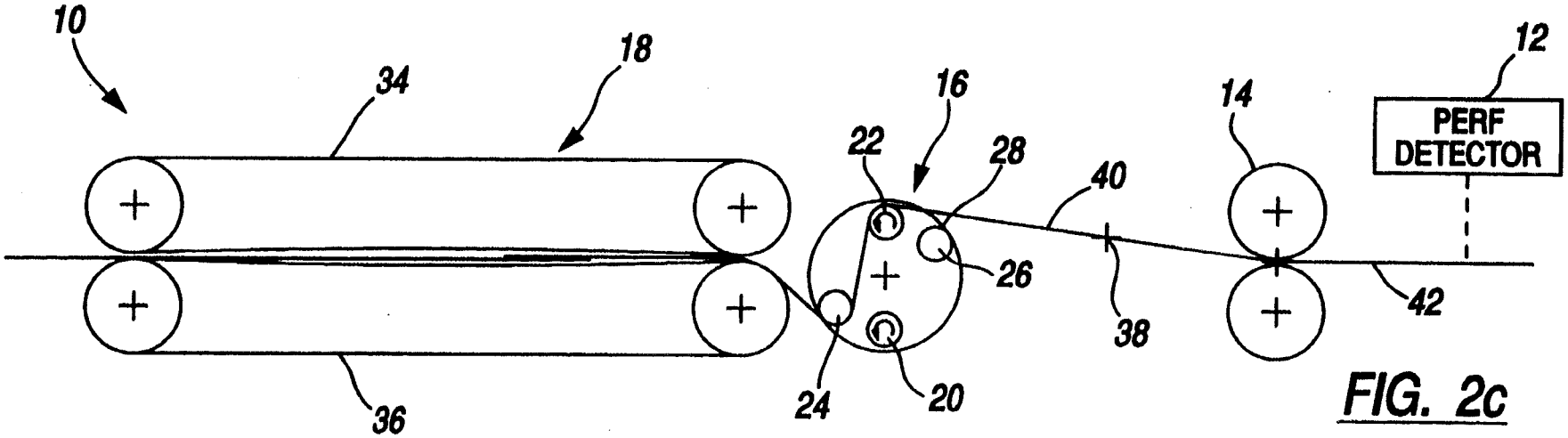
FIG. 2*c* is a side view of the apparatus in FIG. 1 with the festooner rotated about 90 degrees away from the home position to controllably break perforations between the bag and the next adjacent bag.
Figure 2D:
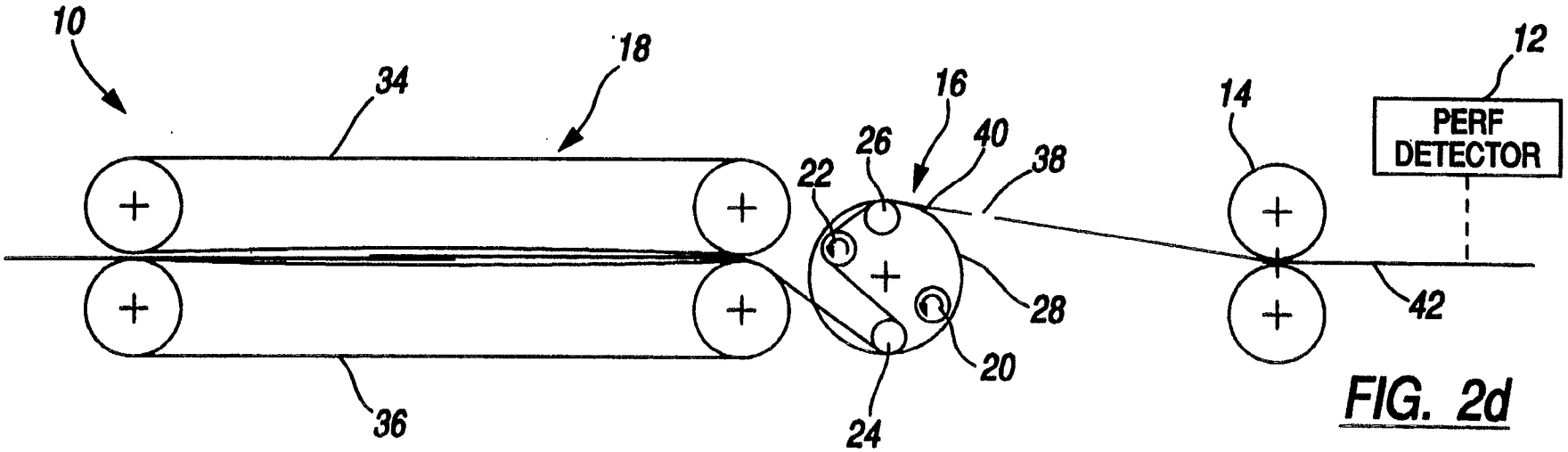
FIG. 2*d* is a side view of the apparatus in FIG. 1 with the festooner being rotated to a second home position following the perforation break to receive the next adjacent bag.

After the perforations 38 are eight inches from the perforation detector 12 (i.e., the processor 13 counts 32 clock pulses), the processor 13 causes the servomotor 30 to drive the hub shaft 28 at a relatively low speed which is approximately one-tenth of the high boost speed (FIG. 2*c*). While the hub shaft 28 rotates at this low speed, the first bag 40 moves about the festooner rollers 22, 24, and 26 as shown in FIG. 2*c*. The slow rotation of the hub shaft 28, in combination with the non-linear configuration of the first bag 40 within the festooner 16, controllably pulls the first bag 40 relative to the second bag 42 to generate tension along the perforations 38. When the tension reaches a threshold, the perforations 38 break to disconnect the first and second bags 40, 42. The perforations 38 break just after the hub shaft 28 is oriented 90 degrees from the home position shown in FIG. 2*a*.

Since the perforations 38 break while the hub shaft 28 is rotating at a relatively slow speed, the first bag 40 is not "jerked" relative to the second bag 42 and the perforations 38 are not "snapped". Instead, the tension threshold for breaking the perforations 38 is gradually approached so that the perforations 38 break in a controlled manner. This controlled breaking allows the apparatus 10 to maintain control over both the first and second bags 40, 42 in general and to maintain control over the trailing portion of the first bag 40 and the leading portion of the second bag 42 in particular. Neither the trailing portion of the first bag 40 nor the leading portion of the second bag 42 swings out of control so as to cause undesired wrap-ups in the conveyor 18 or the in-feed rollers 14, respectively. In addition, the controlled breaking insures that the perforation breaks made by the apparatus 10 are consistent and do not result in skewed bag edges.

Figure 2E:
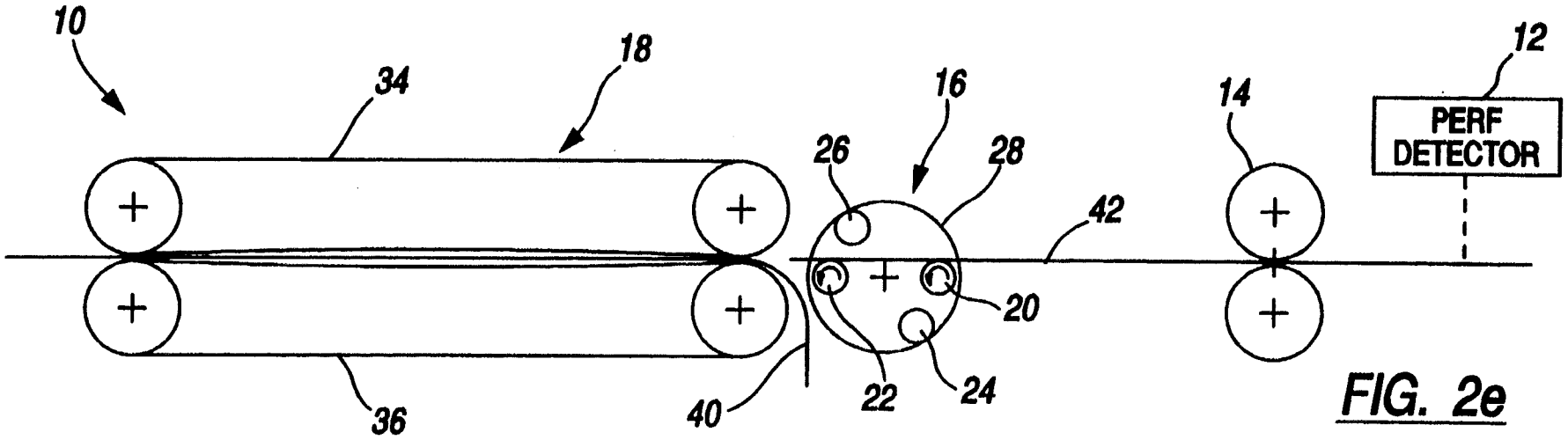
FIG. 2*e* is a side view of the apparatus in FIG. 1 with the festooner in the second home position and the next adjacent bag extending through the festooner.

In the preferred embodiment, the hub shaft 28 rotates through an angle of about 70 degrees while in the low speed. Following the perforation break, the hub shaft 28 is rotated at a high speed to return the festooner 16 to a new home position for receiving the leading edge of the second bag 42 therein (FIG. 2*e*). This high speed is approximately the same rotational speed as the high boost speed which had been used to take up bag slack in FIG. 2*b*. The hub shaft 28 begins rotating at high speed when the leading edge of the second bag 42 is eleven inches (i.e., 44 clock pulses) downstream from the perforation detector 12. The hub shaft 28 rotates at high speed through an angle of about 90 degrees to return the festooner 16 to the new home position. It can be seen from FIG. 2*e* that the new home position of the festooner 16 for receiving the second bag 42 is 180 degrees different from the home position in FIG. 2*a* for receiving the first bag 40. The festooner rollers 20, 22 in FIG. 2*e* are in opposite positions from where they were in FIG. 2*a*, and the rollers 24, 26 in FIG. 2*e* are likewise in opposite positions from where they were in FIG. 2*a*. Since the controlled perforation breaking process employed by the apparatus 10 insures that the leading edge of the second bag 42 is not skewed, the second bag 42 smoothly enters the festooner 16 without causing entanglements.

Figure 2F:
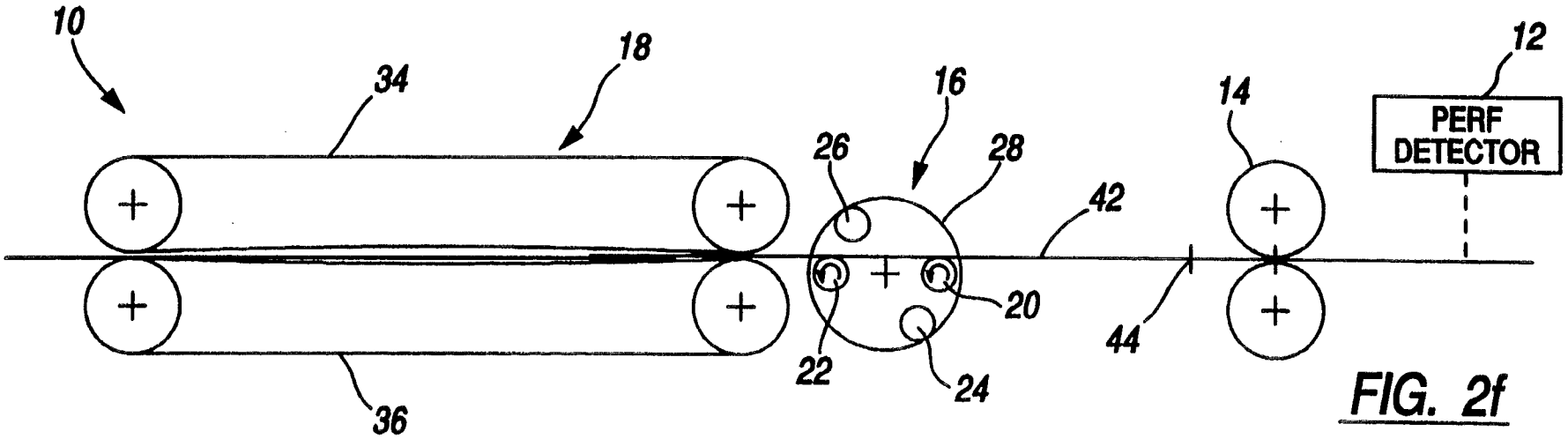
FIG. 2*f* is a side view of the apparatus in FIG. 1 with the festooner in the second home position and the next adjacent bag extending through the festooner and into a conveyor.

The hub shaft 28 remains in the new home position until the leading edge of the second bag 42 passes through the festooner 16 (FIG. 2*e*) and enters the conveyor 18 (FIG. 2*f*). The second bag 42 passes through the festooner 16 by moving over the driven rollers 20, 22. At the same time, the free trailing portion of the first bag 40 gets pulled into the small gap between the conveyor belts 34, 36. Since the tangential velocity of the conveyor 18 is slower than the tangential velocity of the in-feed rollers 14 and festooner rollers 20, 22, the leading edge of the second bag 42 enters the conveyor 18 before the trailing portion of the first bag 40 (FIG. 2*e*). This results in a partial overlap between the first and second bags 40, 42 (FIG. 2*f*). The amount of overlap is determined by the relative tangential velocities of the conveyor 18 and the in-feed rollers 14. The slower the tangential velocity of the conveyor 18 relative to the in-feed rollers 14, the greater the overlap between adjacent bags. In the preferred embodiment, the tangential velocity of the conveyor 18 is approximately three percent slower than the tangential velocity of the in-feed rollers 14.

When the leading edge of the second bag 42 is located 24 inches downstream from the perforation detector 12 (FIG. 2*f*), the entire perforation breaking process is repeated to break the perforations 44 between the second bag 42 and the next upstream adjacent bag. The hub shaft 28 of the festooner 16 is first rotated at high boost speed to take up the slack in the second bag 42 (FIG. 2*b*), is next rotated at slow speed to break the perforations 44 (FIG. 2*c*), and is finally rotated at high speed to return the festooner 16 to the original home position (FIG. 2*e*).

The use of the perforation detector 12 and the processor 13 to control the festooner 16 is advantageous because they cause the hub shaft 28 to change rotational speed based on the location of perforations. Since the timing of the hub shaft 28 follows the location of the perforations passing through the apparatus 10, adjusting the line speed of the feed rollers 14 results in automatic readjustment of the timing of the festooner 16. A drawback of the existing technique for breaking perforations discussed previously is that the timing of the festooner is preset, as opposed to being dependent upon the location of the perforations. Thus, if the bag flow is slightly disturbed, the timing of the festooner is not automatically readjusted. This can result in bag entanglements or inconsistent perforation breaks.

While the present invention has been described with reference to one or more particular embodiments, those skilled in the art will recognize that many changes may be made thereto without departing from the spirit and scope of the present invention.

For example, the apparatus 10 may be constructed and arranged to break perforations between various types of interconnected bags, including food storage bags and garbage bags of all sizes. Moreover, the festooner 16 may be constructed with two rollers, instead of four rollers. When the hub shaft is in the home position in this case, a bag is tangent to the top of one of the rollers and to the bottom of the other of the rollers. As the hub shaft is rotated, the rollers configure the bag into an S-shape, break the perforations between the bag and the next adjacent bag, and then return to a new home position for receiving the adjacent bag. Since only one of the two rollers in this embodiment supports the bottom surface of the bag, additional supports may be provided in the apparatus to properly direct bags into the festooner and the conveyor.

Each of these embodiments and obvious variations thereof is contemplated as falling within the spirit and scope of the claimed invention, which is set forth in the following claims.

We claim:

1. A method for breaking film perforations between a plurality of adjacent films using an in-feed device, an out-feed device, and a festooner positioned between the in-feed device and the out-feed device, the in-feed device and the out-feed device moving the plurality of adjacent films downstream through the festooner, the festooner having a plurality of rollers extending from a rotatable hub shaft, the method comprising the steps of:

(a) rotating the hub shaft to a home position;

(b) feeding a first film through the festooner and into the out-feed device using the in-feed device, the out-feed device moving film downstream at a slower speed than the in-feed device;

(c) rotating the hub shaft at a high boost speed so that the rollers take up slack in the first film generated by the slower speed of the out-feed device relative to the in-feed device; and (d) while the perforations between the first film and an upstream adjacent second film are located between the in-feed device and the festooner, rotating the hub shaft at a slow speed relative to the high boost speed so as to controllably break the perforations.

2. The method of claim 1, wherein step (c) includes rotating the hub shaft at the high boost speed after the leading edge of the first film is located at the out-feed device.

3. The method of claim 2, further including the step of using a perforation detector adjacent the in-feed device to detect the perforations between the first film and the upstream adjacent second film prior to step (d).

4. The method of claim 3, further including the step of notifying a processor, in response to the step of using a perforation detector to detect the perforations between the first film and the upstream adjacent second film, so that the processor keeps track of the location of the perforations.

5. The method of claim 2, further including the step of using a perforation detector adjacent the in-feed device to detect the leading edge of the first film prior to step (c).

6. The method of claim 5, further including the step of notifying a processor, in response to the step of using a perforation detector to detect the leading edge of the first film, so that the processor keeps track of the location of the leading edge of the first film.

7. The method of claim 1, wherein the hub shaft includes two home positions located 180 degrees apart from one another and step (a) includes rotating the hub shaft to one of the two home positions.

8. The method of claim 1, wherein step (b) includes holding the hub shaft stationary.

9. The method of claim 1, wherein step (a) includes rotating the hub shaft to a home position at a high rotational speed faster than the slow speed.

10. The method of claim 1, further including the step of repeating steps (a) through (d) for each pair of adjacent films in the plurality of adjacent films.

11. A method for breaking film perforations between a plurality of adjacent films using a perforation detector, a processor, an in-feed device, an out-feed device, and a festooner positioned between the in-feed device and the out-feed device, the in-feed device and the out-feed device moving the plurality of adjacent films downstream through the festooner, the festooner having a plurality of rollers extending from a rotatable hub shaft, the processor coupled to the perforation detector and the festooner, the method comprising the steps of:

(a) rotating the hub shaft to a home position;

(b) feeding a leading edge of a first film through the festooner and into the out-feed device using the in-feed device;

(c) detecting the leading edge of an upstream adjacent second film using the perforation detector;

(d) in response to step (c), notifying the processor so that the processor keeps track of the location of the leading edge of the second film; and (e) in response to a signal from the processor indicating that the leading edge of the second film is located between the in-feed device and the festooner, rotating the hub shaft at such a speed as to controllably break the perforations between the first film and the second film.

12. The method of claim 11, wherein the out-feed device moves film downstream at a slower speed than the in-feed device, and further including the step of rotating the hub shaft at a high boost speed after the leading edge of the first film is located at the out-feed device so that the rollers take up slack in the first film generated by the slower speed of the out-feed device relative to the in-feed device.

13. The method of claim 12, further including the step of detecting the leading edge of the first film using the perforation detector prior to the step of rotating the hub shaft at the high boost speed.

14. The method of claim 13, further including the step of notifying the processor, in response to the step of detecting the leading edge of the first film, so that the processor keeps track of the location of the leading edge of the first film.

15. The method of claim 11, wherein the hub shaft includes two home positions located 180 degrees apart from one another and step (a) includes rotating the hub shaft to one of the two home positions.

16. The method of claim 11, wherein step (b) includes holding the hub shaft stationary.

17. The method of claim 11, wherein step (a) includes rotating the hub shaft to a home position at a high rotational speed faster than the slow speed.

18. The method of claim 11, further including the step of repeating steps (a) through (e) for each pair of adjacent films in the plurality of adjacent films.

19. A method for breaking film perforations between a plurality of adjacent films using a perforation detector, a processor, an in-feed device, an out-feed device, and a festooner positioned between the in-feed device and the out-feed device, the in-feed device and the out-feed device continuously moving the plurality of adjacent films downstream through the festooner, the festooner having a plurality of rollers extending from a rotatable hub shaft, the processor coupled to the perforation detector and the festooner, the method comprising the steps of:

(a) detecting the leading edge of a first film using the perforation detector;

(b) in response to step (a), notifying the processor so that the processor keeps track of the location of the leading edge of the first film;

(c) rotating the hub shaft to a home position;

(d) feeding the first film through the festooner and into the out-feed device using the in-feed device, the out-feed device moving film downstream at a slower speed than the in-feed device;

(e) detecting the leading edge of an upstream adjacent second film using the perforation detector;

(f) in response to step (e), notifying the processor so that the processor keeps track of the location of the leading edge of the second film;

(g) in response to a signal from the processor indicating that the leading edge of the first film has travelled a predetermined distance such that it is located at the out-feed device, rotating the hub shaft at a high boost speed so that the rollers take up slack in the first film generated by the slower speed of the out-feed device relative to the in-feed device;

(h) in response to a signal from the processor indicating that the leading edge of the second film has travelled a second predetermined distance such that it is located between the in-feed device and the festooner, rotating the hub shaft at a relatively slow speed so as to controllably break the perforations between the first film and the second film; and (i) repeating steps (a) through (h) for each pair of adjacent films in the plurality of adjacent films.

20. An apparatus for breaking film perforations between a plurality of adjacent films, comprising:

an in-feed device for moving the plurality of adjacent films downstream at a first speed as each of the plurality of adjacent films passes therethrough;

an out-feed device for receiving each of the plurality of adjacent films at a downstream locations from said in-feed device and for moving each of the plurality of adjacent films further downstream at a second speed slower than said first speed;

a festooner disposed between said in-feed device and said out-feed device and having a plurality of rollers extending from a rotatable hub shaft, each of said plurality of adjacent films passes between said rollers while moving downstream from said in-feed device to said out-feed device, said festooner receiving each of said plurality of adjacent films while said hub shaft is oriented in a home position;

a perforation detector, disposed adjacent said in-feed device, for detecting said perforations between each of said plurality of adjacent films:

a processor, coupled to said perforation detector and said festooner, for controlling the rotational speed of said hub shaft in response to said perforation detector determining the positions of each of said plurality of adjacent films: arid a drive rotatably driving said hub shaft in response to said processor, said drive first rotating said hub shaft at a high boost speed after each of said plurality of adjacent films is initially fed through said festooner and into said out-feed device so that said rollers take up film slack generated by the slower speed of said out-feed device relative to said in-feed device, said drive then rotating said hub shaft at a slow speed relative to the high boost speed so as to controllably break the perforations while the perforations between each of said plurality of adjacent films and a respective upstream adjacent film are located between said in-feed device and said festooner.

21. The apparatus of claim 20, wherein said in-feed device includes at least one feed roller.

22. The apparatus of claim 20, wherein said out-feed device includes at least one conveyor belt.

23. The apparatus of claim 20, wherein said festooner includes two driven home position rollers and two non-driven non-home position rollers, and wherein each of said plurality of adjacent films moves tangentially over said home position rollers while said hub shaft is oriented in the home position.

24. The apparatus of claim 23, wherein films of said plurality of adjacent films which are located between said in-feed device and said out-feed device are moved linearly downstream by said in-feed device while said hub shaft is oriented in the home position.

25. The apparatus of claim 24, wherein said home position rollers are rotatably driven to move each of said plurality of adjacent films downstream at approximately the same speed as said in-feed device.

26. The apparatus of claim 24, wherein one of said non-home position rollers is located above said home position rollers and the other of said non-home position rollers is located below said home position rollers while said hub shaft is oriented in the home position.

27. The apparatus of claim 26, wherein rotation of said hub shaft away from the home position gradually configures each of said plurality of adjacent films into a general S-shape extending about a home position roller and a non-home position roller while said drive rotates said hub shaft at a high boost speed.

28. The apparatus of claim 27, wherein said hub shaft includes two home positions located 180 degrees apart from one another, and said two home position rollers in one of the two home positions are located in reverse locations relative to the other of the two home positions and said two non-home position rollers in one of the two home positions are located in reverse locations relative to the other of the two home positions.

29. The apparatus of claim 28, further including a perforation detector, disposed adjacent said in-feed device, for detecting the leading edge of each of said plurality of adjacent films.

30. The apparatus of claim 29, further including a processor, coupled to said perforation detector and said drive, for controlling the driving speed of said drive in response to said perforation detector by keeping track of the location of the leading edge of each of said plurality of adjacent films.

31. The apparatus of claim 30, wherein said drive includes a servomotor coupled to said processor.

32. The apparatus of claim 20, wherein after the hub shaft has rotated through a predetermined angle and the perforations are broken, said drive in response to said processor rotates said hub shaft to a second home position for receiving the respective upstream adjacent film.

33. An apparatus for breaking film perforations between a plurality of adjacent films, comprising:

an in-feed device for moving the plurality of adjacent films downstream at a first speed as each of the plurality of adjacent films passes therethrough;

an out-feed device for receiving each of the plurality of adjacent films at a downstream locations from said in-feed device and moving each of the plurality of adjacent films further downstream at a second speed slower than said first speed;

a festooner disposed between said in-feed device and said out-feed device and having a plurality of rollers extending from a rotatable hub shaft, each of said plurality of adjacent films passes between said rollers while moving downstream from said in-feed device to said out-feed device, said festooner receiving each of said plurality of adjacent films while said hub shaft is oriented in a home position;

a drive rotatably driving said hub shaft;

a perforation detector, disposed adjacent said in-feed device, for detecting the leading edge of each of said plurality of adjacent films; and a processor, coupled to said perforation detector and said festooner, for controlling the rotational speed of said hub shaft in response to said perforation detector by keeping track of the location of the leading edge of each of said plurality of adjacent films;

said drive, in response to said processor determining that the leading edge of one of said plurality of adjacent films is located between said in-feed device and said festooner, rotating said hub shaft at such a speed as to controllably break the perforations between said one of said plurality of adjacent films and an upstream adjacent film.

34. The apparatus of claim 33, wherein said in-feed device includes at least one feed roller.

35. The apparatus of claim 33, wherein said in-feed device includes at least one feed roller.

36. The apparatus of claim 33, wherein said festooner includes two driven home position rollers and two non-driven non-home position rollers, and wherein each of said plurality of adjacent films moves tangentially over said home position rollers while said hub shaft is oriented in the home position.

37. The apparatus of claim 36, wherein films of said plurality of adjacent films which are located between said in-feed device and said out-feed device are moved linearly downstream by said in-feed device while said hub shaft is oriented in the home position.

38. The apparatus of claim 37, wherein said home position rollers are rotatably driven to move each of said plurality of adjacent films downstream at approximately the same speed as said in-feed device.

39. The apparatus of claim 37, wherein one of said non-home position rollers is located above said home position rollers and the other of said non-home position rollers is located below said home position rollers while said hub shaft is oriented in the home position.

40. The apparatus of claim 39, wherein rotation of said hub shaft away from the home position gradually configures each of said plurality of adjacent films into a general S-shape extending about a home position roller and a non-home position roller.

41. The apparatus of claim 40, wherein after the hub shaft has rotated through a predetermined angle and the perforations are broken, said drive in response to said processor rotates said hub shaft to a second home position for receiving the upstream adjacent film.

42. The apparatus of claim 41, wherein said hub shaft includes two home positions located 180 degrees apart from one another, and said two home position rollers in one of the two home positions are located in reverse locations relative to the other of the two home positions and said two non-home position rollers in one of the two home positions are located in reverse locations relative to the other of the two home positions.

43. The apparatus of claim 33, wherein said drive includes a servomotor coupled to said processor.

44. The apparatus of claim 33, wherein in response to said processor determining that the leading edge of one of said plurality of adjacent films has travelled a predetermined distance such that it is located at the out-feed device, said drive rotates said hub shaft at a high boost speed so that said rollers take up film slack generated by the slower speed of said out-feed device relative to said in-feed device.

45. The apparatus of claim 44, wherein in response to said processor determining that the leading edge of an upstream film adjacent to said one of said plurality of adjacent films has travelled a second predetermined distance such that it is located between said in-feed device and said festooner, said drive rotates said hub shaft at a slow speed relative to the high boost speed so as to controllably break the perforations between said one of said plurality of adjacent films and said upstream adjacent film.

46. The apparatus of claim 45, wherein after the perforations between said one of said plurality of adjacent films and said upstream adjacent film are broken, said drive rotates said hub shaft to a second home position for receiving said upstream adjacent film.

47. An apparatus for breaking film perforations between a plurality of adjacent films, comprising:

an in-feed device for moving the plurality of adjacent films downstream at a first speed as each of the plurality of adjacent films passes therethrough;

an out-feed device for receiving each of the plurality of adjacent films at a downstream locations from said in-feed device and moving each of the plurality of adjacent films further downstream at a second speed slower than said first speed;

a festooner disposed between said in-feed device and said out-feed device and having a plurality of rollers extending from a rotatable hub shaft, each of said plurality of adjacent films passes between said rollers while moving downstream from said in-feed device to said out-feed device, said festooner receiving each of said plurality of adjacent films while said hub shaft is oriented in a home position;

a drive rotatably driving said hub shaft;

a perforation detector, disposed adjacent said in-feed device, for detecting the leading edge of each of said plurality of adjacent films; and a processor, coupled to said perforation detector and said festooner, for controlling the rotational speed of said hub shaft in response to said perforation detector by keeping track of the location of the leading edge of each of said plurality of adjacent films;

said drive, in response to said processor determining that the leading edge of one of said plurality of adjacent films has travelled a predetermined distance such that it is located at the out-feed device, rotating said hub shaft at a high boost speed so that said rollers take up film slack generated by the slower speed of said out-feed device relative to said in-feed device;

said drive, in response to said processor determining that the leading edge of an upstream film adjacent to said one of said plurality of adjacent films has travelled a second predetermined distance such that it is located between said in-feed device and said festooner, rotating said hub shaft at a slow speed relative to the high boost speed so as to controllably break the perforations between said one of said plurality of adjacent films and said upstream adjacent film;

said drive, after the perforations between said one of said plurality of adjacent films and said upstream adjacent film are broken, rotating said hub shaft to a second home position for receiving said upstream adjacent film.

* * * * *